US011742608B2

(12) United States Patent
Kudo

(10) Patent No.: US 11,742,608 B2
(45) Date of Patent: Aug. 29, 2023

(54) CONNECTOR

(71) Applicant: SUMITOMO WIRING SYSTEMS, LTD., Mie (JP)

(72) Inventor: Yasuhiro Kudo, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 170 days.

(21) Appl. No.: 17/295,551

(22) PCT Filed: Oct. 30, 2019

(86) PCT No.: PCT/JP2019/042546
§ 371 (c)(1),
(2) Date: May 20, 2021

(87) PCT Pub. No.: WO2020/105385
PCT Pub. Date: May 28, 2020

(65) Prior Publication Data
US 2022/0021148 A1 Jan. 20, 2022

(30) Foreign Application Priority Data
Nov. 20, 2018 (JP) ..... 2018-217133

(51) Int. Cl.
*H01R 13/44* (2006.01)
*H01R 4/38* (2006.01)
(Continued)

(52) U.S. Cl.
CPC ..... *H01R 13/44* (2013.01); *H01R 4/38* (2013.01); *H01R 13/516* (2013.01); *H01R 13/5213* (2013.01); *H01R 13/66* (2013.01)

(58) Field of Classification Search
CPC ..... H01R 2201/26; H01R 9/2408; H01R 2103/00; H01R 13/6215; H01R 4/34; H01R 9/24; H01R 4/30; H01R 11/12
See application file for complete search history.

(56) References Cited

U.S. PATENT DOCUMENTS 5,508,693 A * 4/1996 Wake ..... G06K 7/087 340/5.31
5,791,936 A * 8/1998 Nicholson ..... H01R 13/5213 439/521
(Continued)

FOREIGN PATENT DOCUMENTS

JP H09-274947 A 10/1997
JP 2011-198585 A 10/2011
(Continued)

OTHER PUBLICATIONS

International Search Report dated Dec. 10, 2019 for WO 2020/105385 A1 (4 pages).

*Primary Examiner* — Truc T Nguyen
(74) *Attorney, Agent, or Firm* — Venjuris, P.C.

(57) ABSTRACT

A connector includes a first terminal formed with a penetrating first fastening hole, a first housing for holding the first terminal, a second terminal connectable to an external terminal and formed with a penetrating second fastening hole, a second housing including an insulating cover portion for covering the second terminal with a part of the second terminal on the side of the first terminal exposed, the second housing holding the second terminal, a conductive relay portion disposed in a part of the second housing where the second terminal is exposed, the relay portion electrically connecting the first terminal and the second terminal, and a fastening member for fastening the first terminal, the second terminal and the relay portion with the relay portion sandwiched between the first terminal and the second terminal.

4 Claims, 10 Drawing Sheets

(51) Int. Cl.
*H01R 13/516* (2006.01)
*H01R 13/52* (2006.01)
*H01R 13/66* (2006.01)

(56) References Cited

U.S. PATENT DOCUMENTS 6,255,927 B1 * 7/2001 Fischer ..... H01R 11/12 439/810
6,317,332 B1 * 11/2001 Weber ..... E05F 15/697 310/71
6,452,100 B1 * 9/2002 Marcinek ..... H01R 13/512 174/67
6,699,067 B1 * 3/2004 Zhao ..... H01R 12/7088 439/516
7,070,461 B1 * 7/2006 Pavlovic ..... H01R 11/12 439/766
7,591,660 B1 * 9/2009 Eichhorst ..... H01R 9/24 439/721
7,785,158 B1 * 8/2010 McCoy ..... H01M 50/567 439/627
2006/0244555 A1 * 11/2006 Janot ..... H01H 50/043 335/78
2014/0024239 A1 1/2014 Tanaka et al.
2018/0159263 A1 * 6/2018 Kashiwada ..... H01R 13/5213
2018/0269624 A1 * 9/2018 Iwabe ..... H01R 13/6215
2019/0027924 A1 * 1/2019 O'Regan ..... H02H 7/26
2020/0313357 A1 * 10/2020 Iizuka ..... H01R 13/648
2021/0170963 A1 * 6/2021 Tashiro ..... H01R 9/24
2022/0021148 A1 * 1/2022 Kudo ..... H01R 31/06

FOREIGN PATENT DOCUMENTS

JP 2016-025033 A 2/2016
JP 2017-010765 A 1/2017
JP 2017-221083 A 12/2017

* cited by examiner

CONNECTOR

CROSS REFERENCE TO RELATED APPLICATIONS

This application is a national phase of PCT application No. PCT/JP2019/042546, filed on 30 Oct. 2019, which claims priority from Japanese patent application No. 2018-217133, filed on 20 Nov. 2018, all of which are incorporated herein by reference.

TECHNICAL FIELD

A technique relating to a connector is disclosed in this specification.

BACKGROUND

Conventionally, a technique for connecting terminals by bolting is known. In a charging connector of Patent Document 1, terminals crimped and connected to a pair of power supply wires are accommodated in an opening of a housing and covered by a housing cover slidably assembled with the housing. This charging connector includes a safety circuit, energization to the power supply wires is shut off by the safety circuit in a state where the housing cover is open, and the power supply wires and a mating terminal cover are connected by bolting in this state. If the housing cover is closed after bolting, the power supply wires are energized by the safety circuit.

PRIOR ART DOCUMENT

Patent Document

Patent Document 1: JP 2011-198585 A

SUMMARY OF THE INVENTION

Problems to be Solved

In the above configuration, if the safety circuit does not properly function due to a certain cause, the power supply wires and the terminals are energized in the state where the housing cover is open. If a worker works in such a case where the safety circuit does not properly function, there is a concern for an electric shock and the like due to the contact of the worker or an external matter with the power supply wire or terminal.

The technique described in this specification was completed on the basis of the above situation and aims to suppress the contact of a worker or the like with terminals during a connector operation in which the terminals are connected by bolting.

Means to Solve the Problem

A connector described in this specification includes a first terminal formed with a penetrating first fastening hole, a first housing for holding the first terminal, a second terminal connectable to an external terminal, the second terminal being formed with a penetrating second fastening hole, a second housing including an insulating cover portion for covering the second terminal with a part of the second terminal on the side of the first terminal exposed, the second housing holding the second terminal, a conductive relay portion disposed in a part of the second housing where the second terminal is exposed, the relay portion electrically connecting the first terminal and the second terminal, and a fastening member for fastening the first terminal, the second terminal and the relay portion with the relay portion sandwiched between the first terminal and the second terminal.

According to the above configuration, since the part of the second terminal of the connector on the side of the first terminal is covered by the insulating cover portion of the second housing, contact with the second terminal can be suppressed by the cover portion when a worker performs an operation on the side of the second housing. Further, even in this configuration, the relay portion is disposed in the part of the second housing where the second terminal is exposed and the first terminal, the second terminal and the relay portion are fastened by the fastening member, wherefore the first terminal and the second terminal can be electrically connected via the relay portion. Thus, the contact of the worker or the like with the terminal can be suppressed during a connector operation in which the terminals are connected by bolting.

The following modes are preferable as embodiments of the technique described in this specification.

The second housing includes the cover portion and a hole portion for exposing a part of the cover portion, and the relay portion is inserted into the hole portion.

By this arrangement, since the hole portion is covered around by the cover portion, the contact of the worker or the like with the terminal can be even more suppressed.

The relay portion is constituted by a tubular metal piece, and the hole portion forms a tubular space.

By this arrangement, the strength of the relay portion can be enhanced while the configuration thereof is simplified.

The cover portion includes an extending portion extending inwardly of the second fastening hole.

By this arrangement, the contact of the worker or the like with a hole wall of the second fastening hole can be suppressed.

Effect of the Invention

According to the technique described in this specification, it is possible to suppress the contact of a worker or the like with terminals during a connector operation in which the terminals are connected by bolting.

DETAILED DESCRIPTION TO EXECUTE THE INVENTION

Embodiment

A connector 10 of an embodiment is described with reference to FIGS. 1 to 10.

Figure 1:
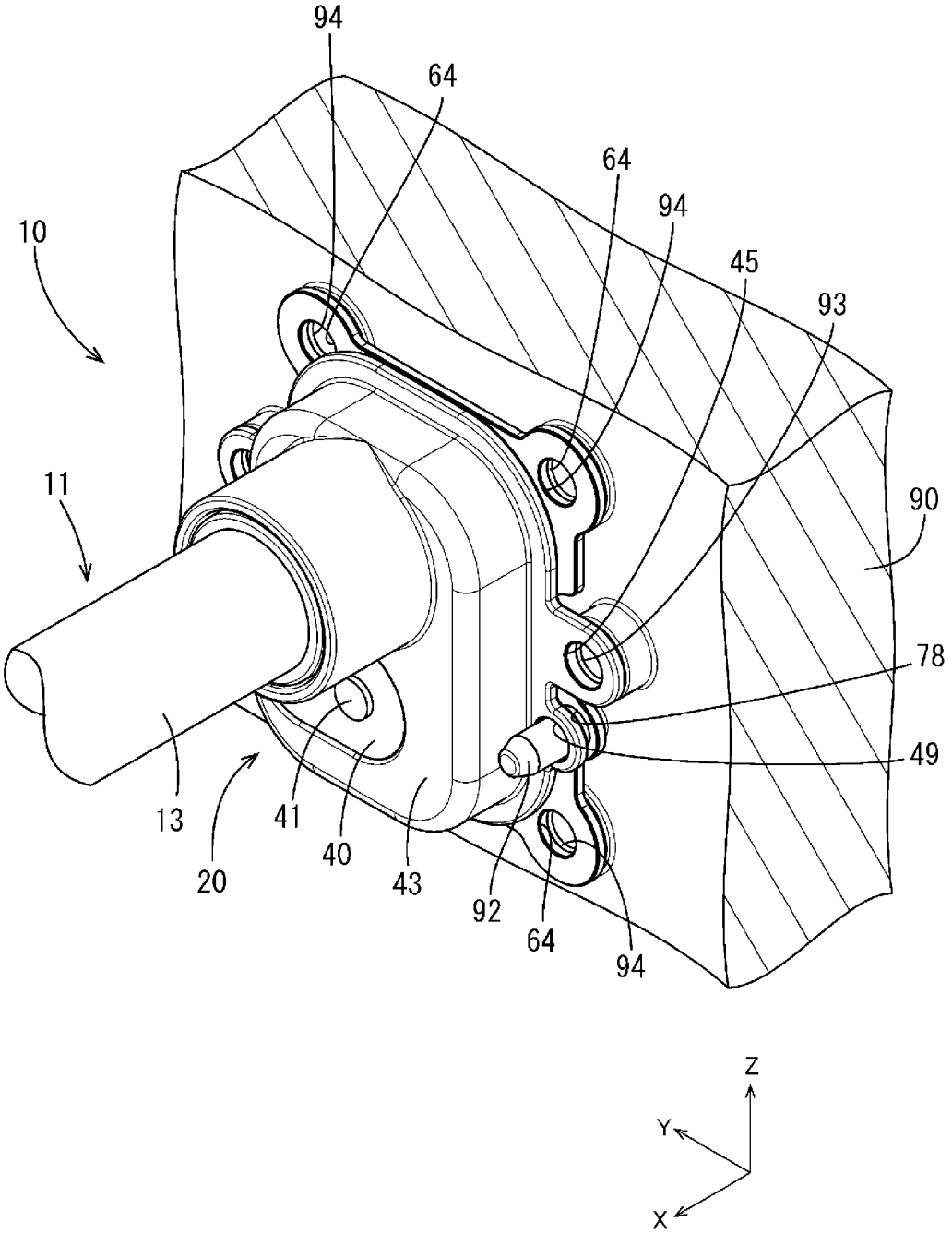
FIG. 1 is a perspective view showing a state where a connector of an embodiment is mounted on a case.

The connector 10 (FIG. 6) of this embodiment is configured by assembling a first connector 20 and a second connector 50 and can be fixed, for example, to a case 90 of a battery or a device such as an inverter or motor in a power supply path of a vehicle such as a hybrid vehicle or electric vehicle. In the following description, a direction in which the first and second connectors 20, 50 are facing each other is referred to as a forward direction and a Y direction and a Z direction of FIG. 1 are referred to as a rightward direction and an upward direction.

Figure 2:
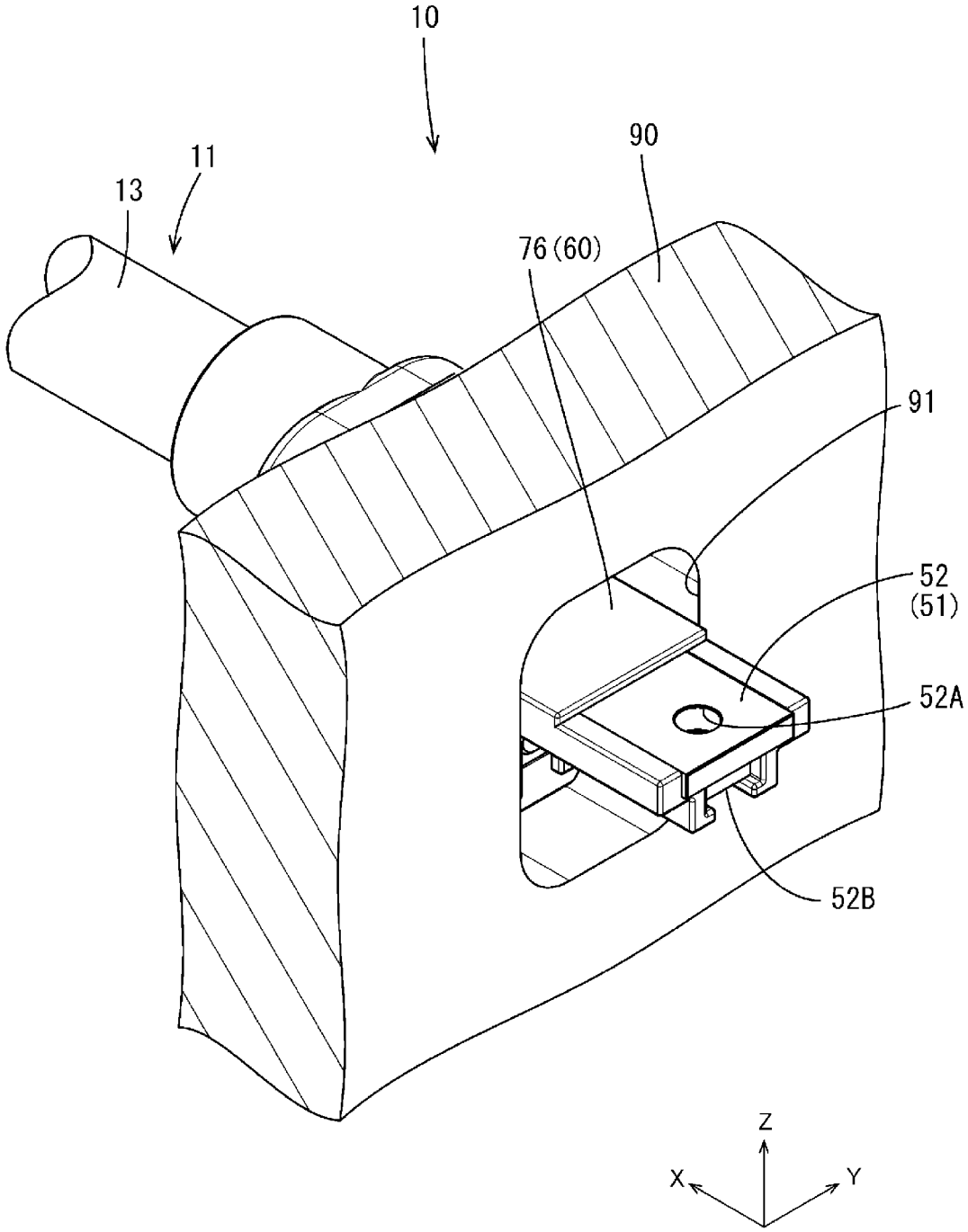
FIG. 2 is a perspective view showing the mounted state of the connector on the case from a direction different from that of FIG. 1.
Figure 3:
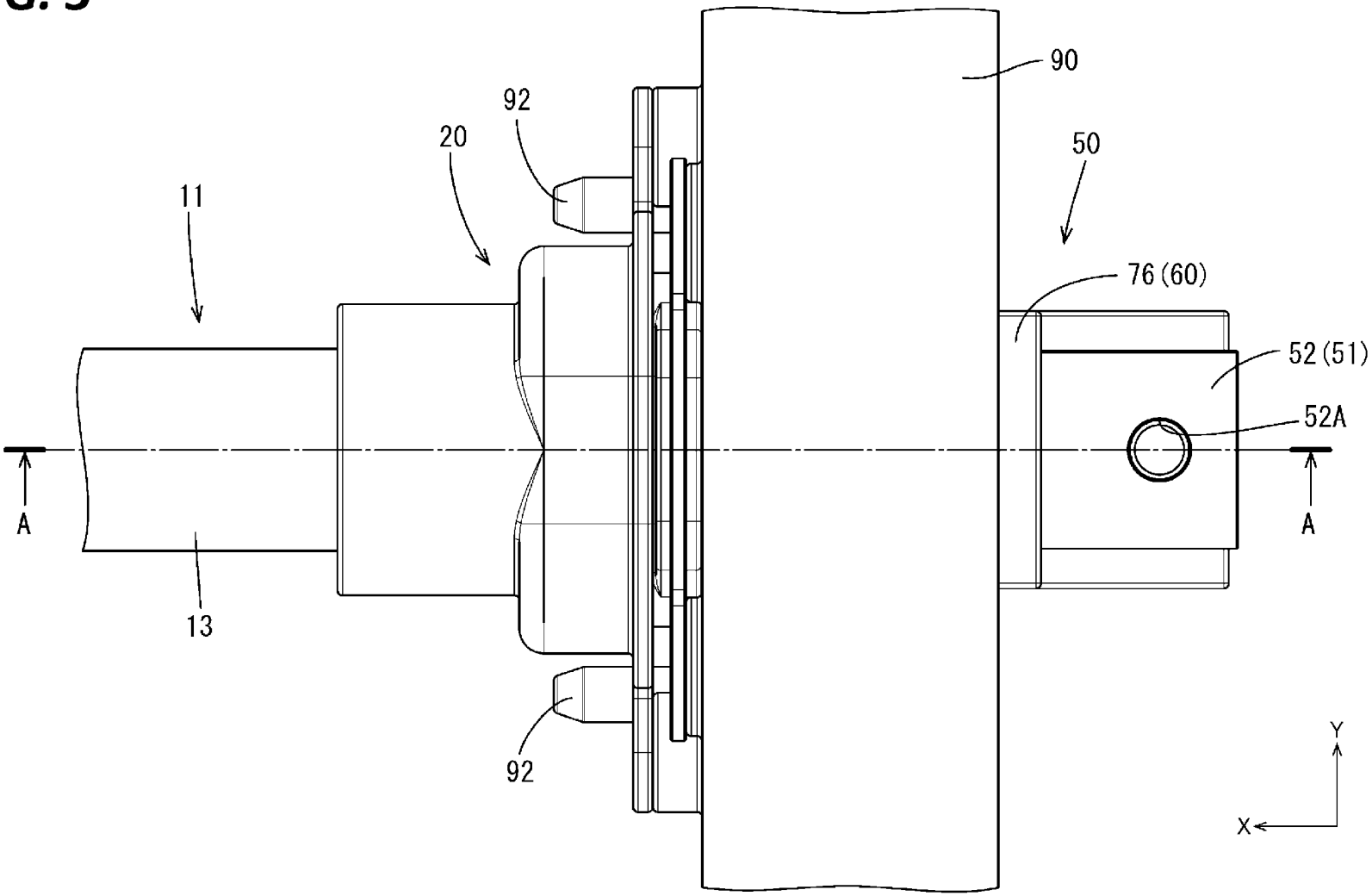
FIG. 3 is a plan view showing the mounted state of the connector on the case.
Figure 4:
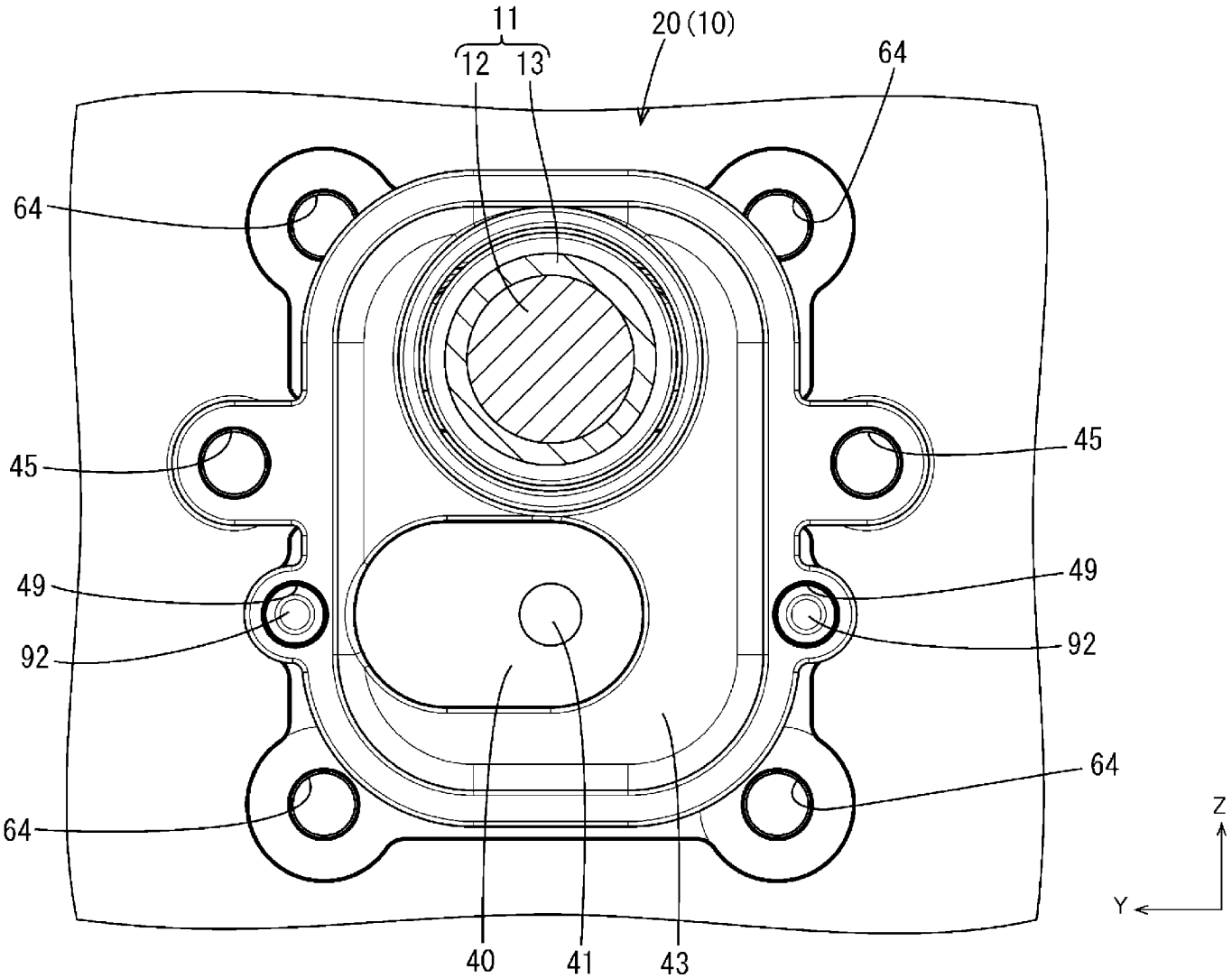
FIG. 4 is a front view showing the mounted state of the connector on the case.
Figure 5:
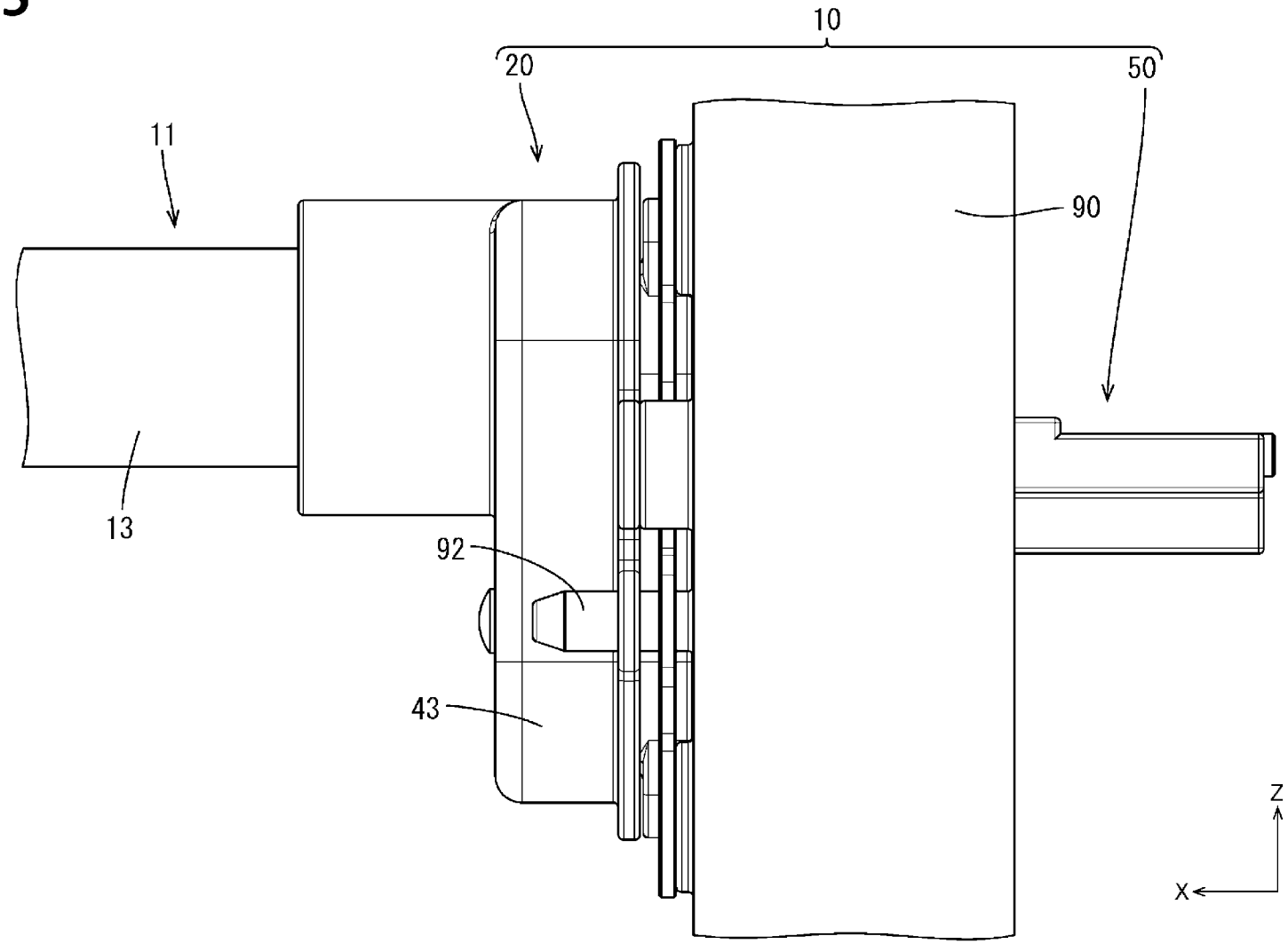
FIG. 5 is a side view showing the mounted state of the connector on the case.

The case 90 (only a part of the case 90 is shown and other parts are not shown) is, for example, made of metal such as aluminum or aluminum alloy, and formed with a penetrating substantially rectangular connector insertion hole 91 as shown in FIG. 2. As shown in FIGS. 1 and 4, a plurality of positioning pins 92 for positioning the connector 10 and screw portions 93, 94 where the connector 10 is fixed by screwing are formed around the connector insertion hole 91. The positioning pins 92 hold the first and second connectors 20, 50 in position by being inserted into positioning holes 49, 78 provided in both the first connector 20 and the second connector 50. The screw portions 93 are fastened by screws (not shown) inserted into mounting holes 45 of the first connector 20, and the screw portions 94 are fastened by screws (not shown) inserted into mounting holes 64 of the second connector 50.

Figure 6:
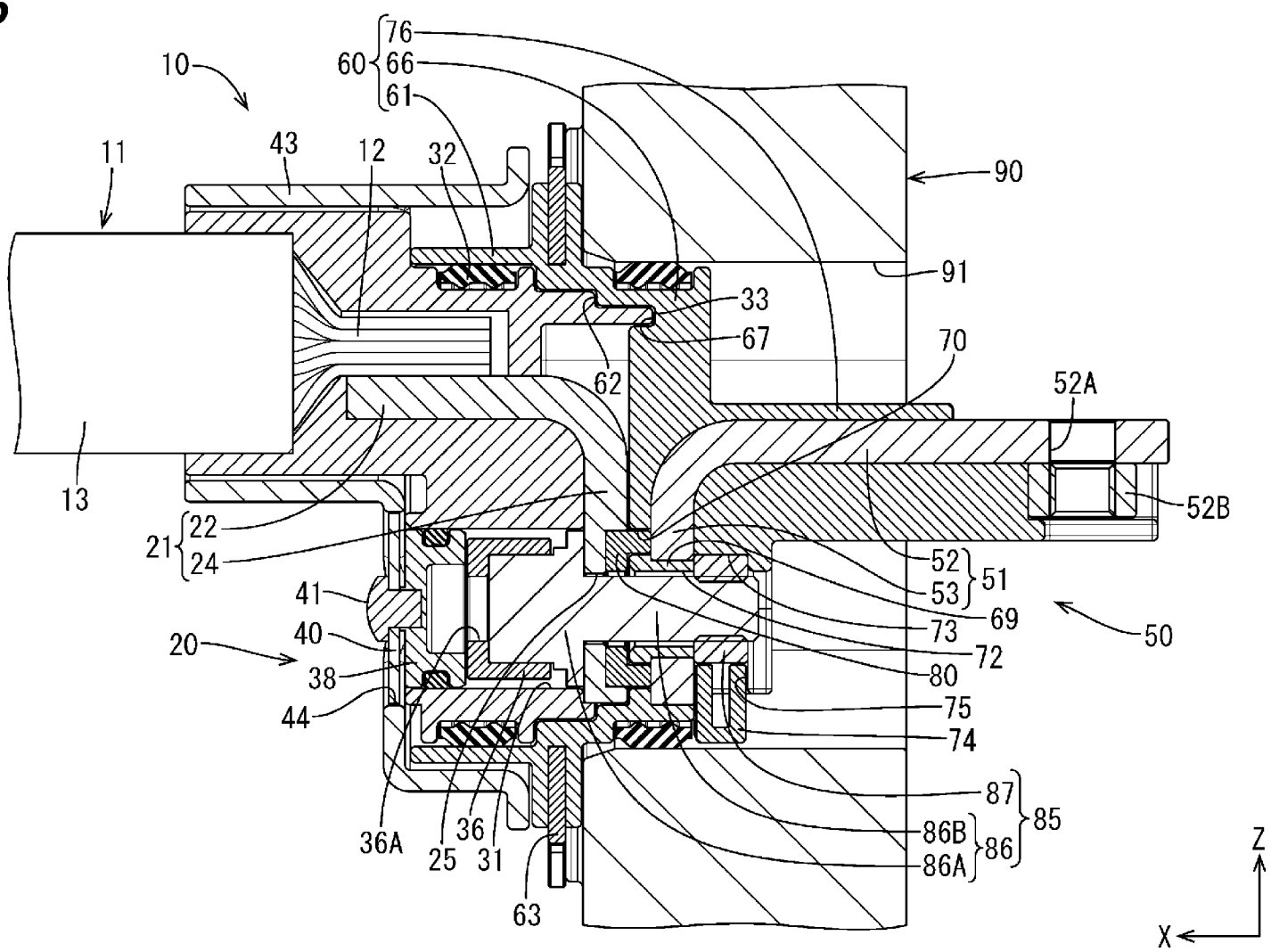
FIG. 6 is a section along A-A of FIG. 3.
Figure 7:
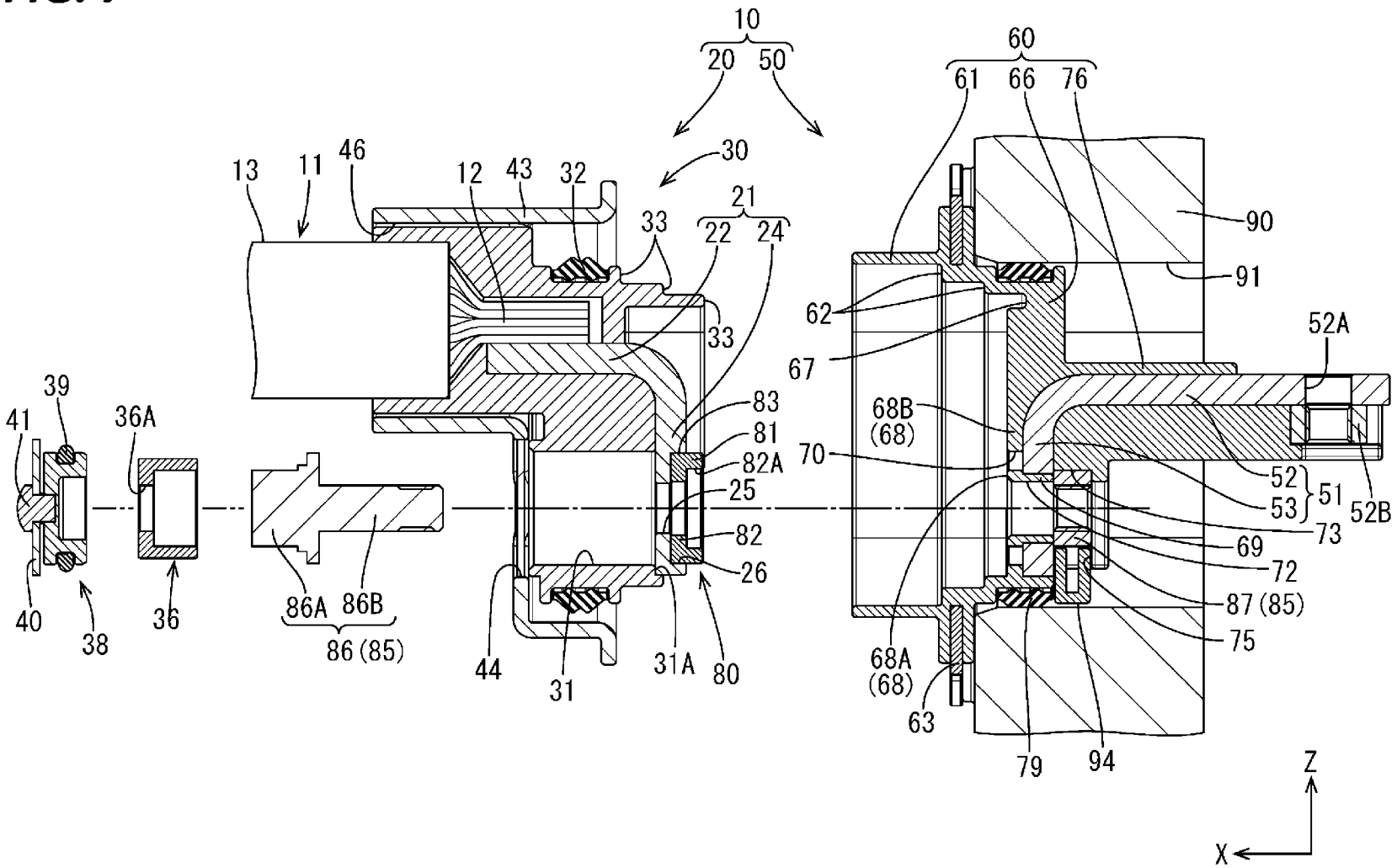
FIG. 7 is a section showing the connector to be mounted on the case in a disassembled state.

As shown in FIGS. 6 and 7, the connector 10 includes the first connector 20 having a first terminal 21, the second connector 50 to be connected to the first connector 20 and having a second terminal 51, and a fastening member 85 for fastening the first terminal 21 and the second terminal 51.

The first connector 20 includes the first terminal 21 to be connected to an end part of a wire 11, a first housing 30 for holding the first terminal 21 and a conductive relay portion 80 for electrically connecting the first and second terminals 21, 51 by being sandwiched between the first and second terminals 21, 51. The wire 11 is a coated wire configured such that a conductor portion 12 composed of a multitude of metal thin wires is surrounded by an insulation coating 13 (insulation layer), and the insulation coating 13 is stripped to expose the conductor portion 12 in an end part of the wire 11.

The first terminal 21 is in the form of a metal plate made of copper, copper alloy, aluminum, aluminum alloy or the like, and includes an L-shaped wire connecting portion 22 to be connected to the wire 11 and a first fastening portion 24 extending in a direction orthogonal to an extending direction of the wire connecting portion 22 and to be disposed on the front surface of the first housing 30. The wire connecting portion 22 is connected to the conductor portion 12 of the wire 11 by crimping, welding or the like. A circular first fastening hole 25 is formed to penetrate through a tip part of the first fastening portion 24.

The first housing 30 is made of insulating synthetic resin and formed with a work hole 31 through which (a head portion 86A) of a bolt 86 serving as the fastening member 85 is insertable. The work hole 31 has a circular shape, an opening 31A on a front side of the work hole 31 is closed by the first fastening portion 24 of the first terminal 21 and the first fastening hole 25 is disposed at a position communicating with the work hole 31. A sealing ring 32 made of rubber is mounted on the outer periphery of the first housing 30. The sealing ring 32 is sandwiched between the outer periphery of the first housing 30 and a receptacle 61 of a second housing 60 for waterproofing. A contact portion 33 configured to come into contact with the second housing 60 is provided on a front side of the first housing 30. The contact portion 33 has a ring shape and comes into contact with a recess 67 and step portions 62 on the front surface of the second housing 60 to maintain relative positions of the first and second housings 30, 60 in a front-rear direction.

An insulating cap 36 and a sealing cap 38 are disposed behind the head portion 86A of the bolt 86 in the work hole 31. The insulating cap 36 is made of insulating synthetic resin and insulates a rear side of the bolt 86 by being fit to the head portion 86A of the bolt 86. The insulating cap 36 is formed with a through hole 36A through which a shaft portion 86B of the bolt 86 is inserted.

The sealing cap 38 is disposed behind the insulating cap 36, and a cap ring 39 made of rubber is mounted on the outer periphery of a disk-like body of the sealing cap 38. The body of the sealing cap 38 is made of synthetic resin or metal and waterproofs a region closer to the bolt 86 than the sealing cap 38 by the cap ring 39 being fit into the work hole 31 to be held in close contact with the inner wall of the work hole 31. A grip portion 41 grippable by the worker is attached to the rear surface of the sealing cap 38. A lid 40 made of metal for covering and shielding the sealing cap 38 is mounted on the grip portion 41. The outer surface of the first housing 30 is covered by a shield shell 43 made of metal such as aluminum or aluminum alloy. The shield shell 43 is provided to cover the end part of the wire 11 and the entire outer periphery of the first housing 30, and a work hole 44 through which the fastening member 85 and the like are inserted when the fastening member 85 is mounted and the mounting holes 45 (FIG. 4) for mounting on the case 90 are formed to penetrate through the shield shell 43.

As shown in FIG. 7, the relay portion 80 is a metal collar having a hollow cylindrical shape and made of metal such as copper, copper alloy, aluminum, aluminum alloy or iron, and includes a hollow cylindrical tubular portion 81 and a protrusion 82 projecting inwardly of the tubular portion 81, and the inside of the relay portion 80 serves as a through hole 82A through the shaft portion 86B of the bolt 86 is inserted. The protrusion 82 projects a constant distance in a stepped manner over the entire periphery of the inner wall of the relay portion 80 on a rear side in an axial direction of the through hole 82A. A part of the relay portion 80 on the side of the first terminal 21 serves a press-fit portion 83 to be press-fit into a press-fit recess 26 of the first fastening portion 24 of the first terminal 21, and a part thereof on a side opposite to the press-fit portion 83 contacts the front surface of the second fastening portion 53 of the second terminal 51.

Figure 8:
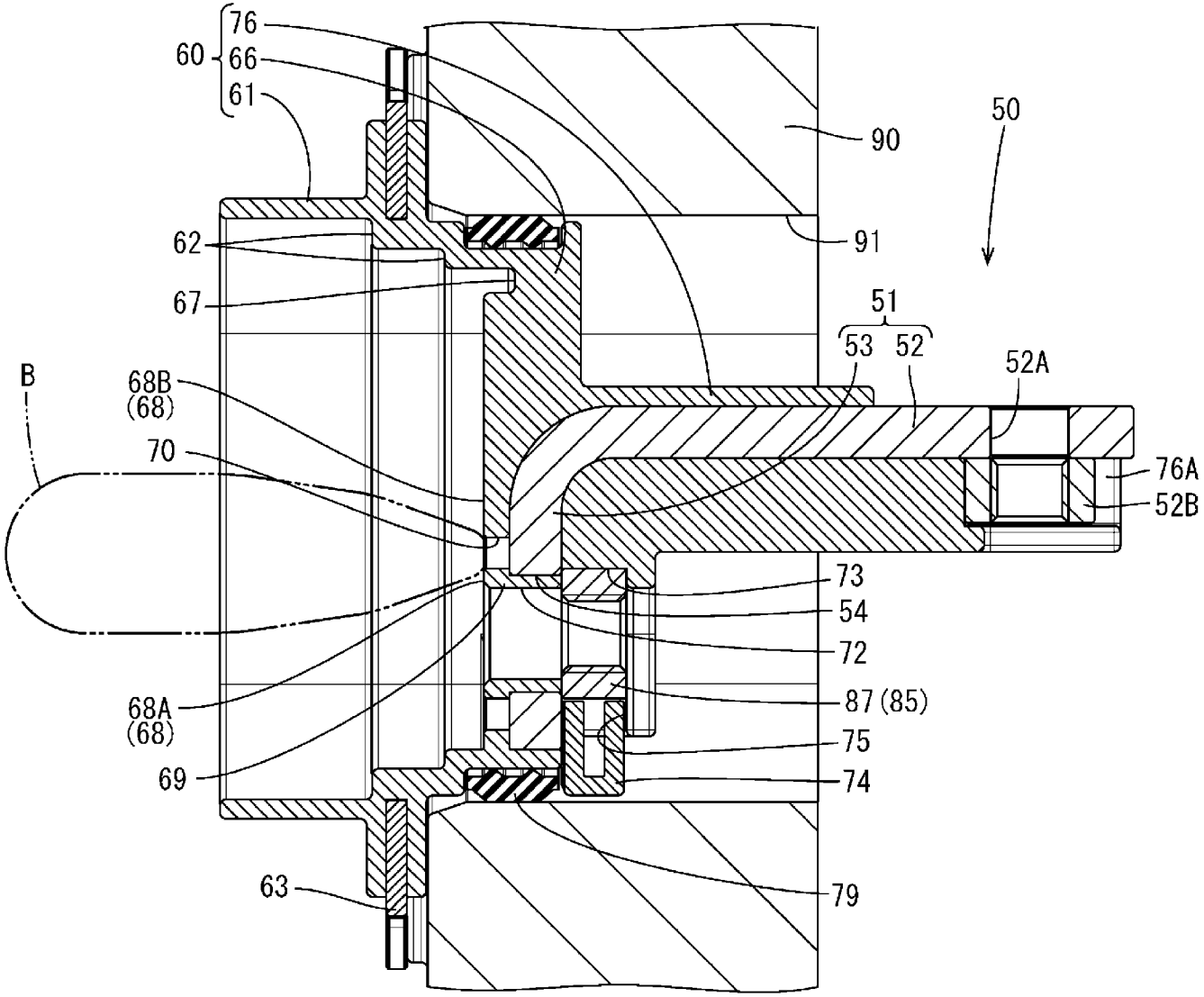
FIG. 8 is a section showing a mounted state of a second connector on the case.

As shown in FIG. 8, the second connector 50 includes the second terminal 51 connectable to an external terminal and the second housing 60 for holding the second terminal 51. The second terminal 51 is in the form of a metal plate made of copper, copper alloy, aluminum, aluminum alloy or the like, and includes an L-shaped terminal connecting portion 52 to be connected to the external terminal and a second fastening portion 53 extending in a direction (vertical direction) orthogonal to an extending direction (front-rear direction) of the terminal connecting portion 52 and to be disposed on a front surface side of the second housing 60. The terminal connecting portion 52 is formed with a through hole 52A for connection to the external terminal.

The second fastening portion 53 is formed with a penetrating second fastening hole 54 through which the shaft portion 86B of the bolt 86 is insertable. The second fastening hole 54 has a circular shape dimensioned to form a predetermined clearance (clearance in which an extending portion 69 to be described later is disposed) between the outer periphery an outer diameter of the shaft portion 86B and the inner wall of the second fastening hole 54.

The first housing 60 is made of insulating synthetic resin and includes the receptacle 61 into which the first housing 30 is fit, a back wall portion 66 for closing the receptacle 61 and a connection holding portion 76 for holding the terminal connecting portion 52 of the second terminal 51 in a close contact state. A plurality of step portions 62 are formed in a stepped manner to reduce an inner diameter toward a front side on the inner surface of the receptacle 61. The step portions 62 annularly extend on the inner surface of the receptacle 61. A case mounting portion 63 for mounting on the case 90 is provided on the outer peripheral surface of the receptacle 61. The case mounting portion 63 is in the form of a flat plate made of metal and formed with a plurality of the penetrating mounting holes 64 (FIG. 4).

As shown in FIG. 8, the connection holding portion 76 extends rearward along the terminal connecting portion 52 and is provided with an accommodation recess 76A for accommodating a nut 52B for external connection. The accommodation recess 76A is provided below the through hole 52A of the terminal connecting portion 52.

Figure 9:
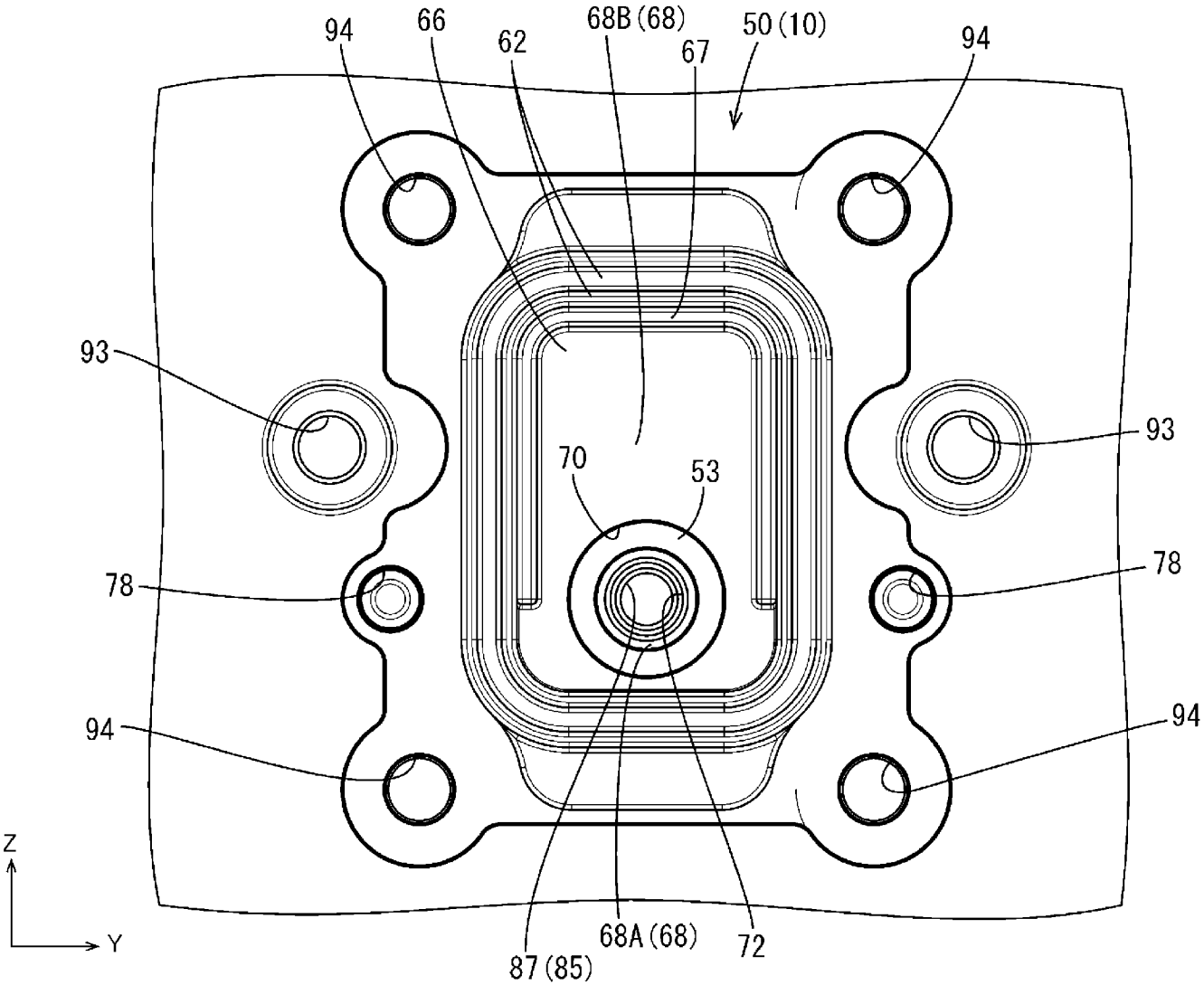
FIG. 9 is a front view showing the mounted state of the second connector on the case.

The back wall portion 66 is provided to close a rear side of the receptacle 61, and the annular recess 67 is formed along the receptacle 61 on the front surface of the back wall portion 66. A sealing ring 79 made of rubber is mounted on the outer periphery of the back wall portion 66. An insertion hole 72 through which the fastening member 85 is insertable is formed to penetrate through a lower side of the back wall portion 66 in the front-rear direction. As shown in FIG. 9, the recess 67 in the front surface of the back wall portion 66 is formed into a U shape in a region above the insertion hole 72. As shown in FIG. 8, the back wall portion 66 is formed with an insulating cover portion 68 (an example of a "cover portion") for covering the front surface (surface on the side of the receptacle 61) of the second fastening portion 53 and a hole portion 70 for exposing the second terminal 51.

Figure 10:
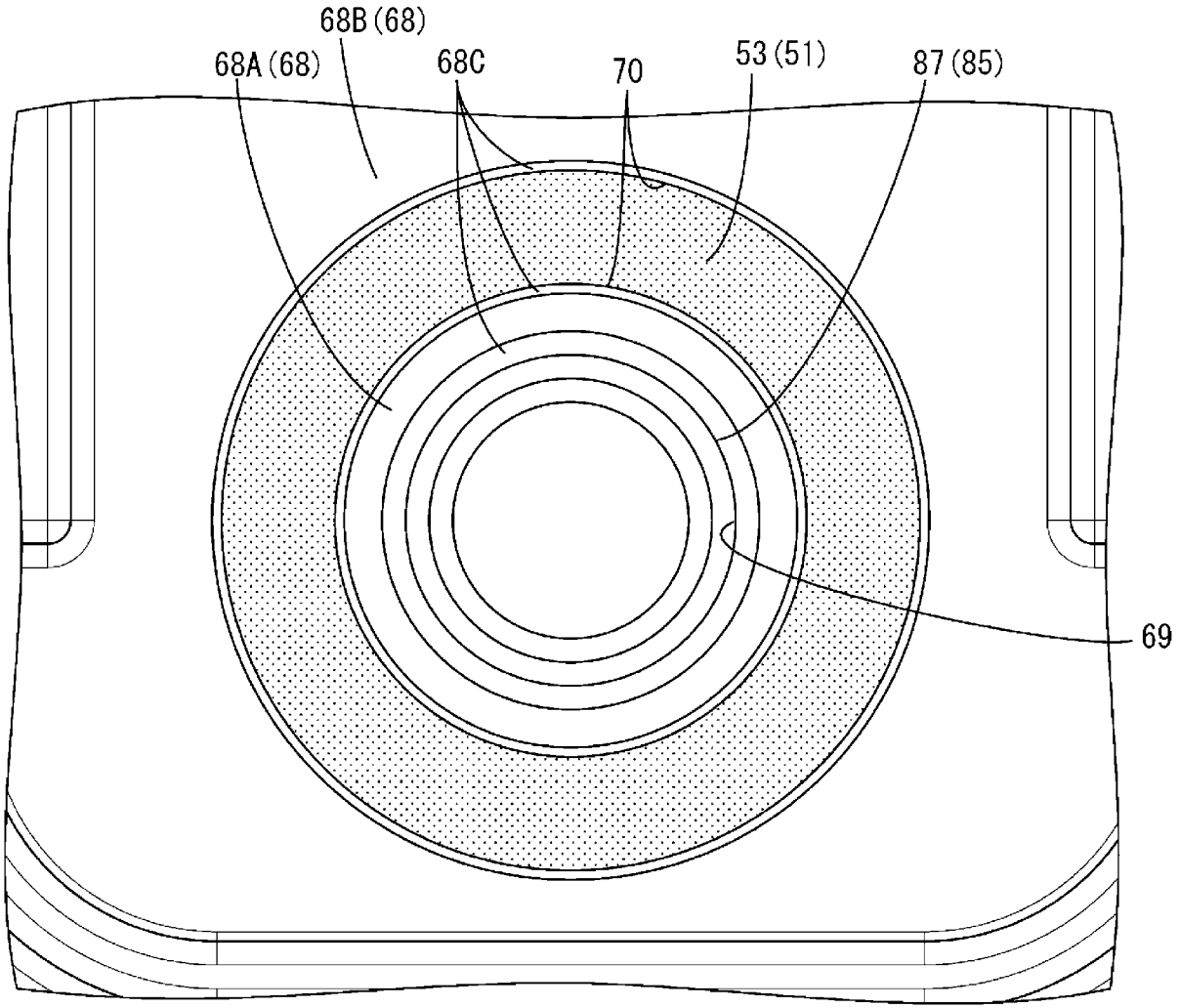
FIG. 10 is a view enlargedly showing a part of FIG. 9.

The insulating cover portion 68 is overlapped on the second fastening portion 53 on a front side of the second fastening portion 53 and formed to have a thickness capable of preventing an electric shock by insulating synthetic resin for the second fastening portion 53. At a position of the insulating cover portion 68 adjacent to the second fastening hole 54 (and the insertion hole 72), the insulating cover portion 68 is not overlapped on the second fastening portion 53 and the hole portion 70 for exposing the second fastening portion 53 is provided. As shown in FIG. 10, the hole portion 70 is provided in an annular region around the second fastening hole 54 and, out of the insulating cover portion 68, the inside of the hole portion 70 serves as an inner cover portion 68A and the outside of the hole portion 70 serves as an outer cover portion 68B. Tapered surfaces 68C are formed on an edge part of the outer cover portion 68B on the side of the hole portion 70 and edge parts on both inner and outer sides of the inner cover portion 68A.

As shown in FIG. 8, the inner cover portion 68A includes the extending portion 69 extending rearward to cover the inner wall of the second fastening hole 54. The extending portion 69 has a hollow cylindrical shape and is laminated on the inner wall of the second fastening hole 54 and formed to have a thickness capable of preventing an electric shock for the inner wall of the second fastening hole 56. The inner surface of the extending portion 69 serves as the inner wall of the insertion hole 72 through which the shaft portion 86B of the bolt 86 is inserted. A part of the inner wall of the insertion hole 72 behind the extending portion 69 serves as a fastening member accommodating portion 73 for accommodating a nut 87 serving as the fastening member 85. The nut 87 accommodated in the fastening member accommodating portion 73 is held in the fastening member accommodating portion 73 by a retaining portion 74 with rotation restricted by a polygonal inner wall of the fastening member accommodating portion 73. The nut 87 and the retaining portion 74 can be attached and removed by being passed through a communication hole 75 allowing communication between the fastening member accommodating portion 73 and outside.

The fastening member 85 is composed of the bolt 86 and the nut 87. The bolt 86 includes the shaft portion 86B having a screw hole formed on an outer periphery and the head portion 86A having a larger outer diameter than the shaft portion 86B. The shaft portion 86B is inserted into the first fastening hole 25, the through hole 82A of the relay portion 80 and the insertion hole 72 of the extending portion 69 and fastened by the nut 87.

A manufacturing method of the connector 10 is described.

The wire 11 is inserted into a wire through hole 46 (see FIG. 7) of the shield shell 43 in advance, and the first terminal 21 is connected to the conductor portion 12 exposed by removing the insulation coating 13 on the end part of the wire 11 by crimping, welding or the like. Further, the relay portion 80 is press-fit into the press-fit recess 26 of the first terminal 21 and fixed to the first terminal 21. Subsequently, the first terminal 21 connected to the end part of the wire 11 is disposed in a mold (not shown), and the first housing 30 is formed by performing insert molding to inject a resin into the mold. Then, the sealing ring 32 is mounted on the outer periphery of the first housing 30 and the shield shell 43 is moved forward and mounted on the outer periphery of the first housing 30, whereby the first connector 20 is formed. Note that although the relay portion 80 is press-fit into the first terminal 21 before the first housing 30 is formed, the relay portion 80 may be press-fit into the first terminal 21 after the first housing 30 is formed.

Further, the case mounting portion 63 and the second terminal 51 are disposed in a mold (not shown) and the second housing 60 is formed by performing insert molding to inject a resin into the mold. Subsequently, the sealing ring 79 is mounted on the outer periphery of the back wall portion 66 and the nut 87 is inserted into the communication hole 75 and positioned by the retaining portion 74. In this way, the second connector 50 is formed.

Subsequently, the second connector 50 is fit into the connector insertion hole 91 of the case 90, the case mounting portion 63 is screwed to fix the second connector 50 to the case 90, and the second terminal 51 is connected to the terminal to which power can be supplied from outside. In this state, as shown in FIG. 8, the second fastening portion 53 of the second terminal 51 is covered by the insulating cover portion 68 of the second housing 60 and the hole portion 70 is small for the worker's fingertip or the like B, wherefore the contact of the worker or an external matter with the second fastening portion 53 is suppressed.

Subsequently, as shown in FIG. 7, the first connector 20 is connected to the second connector 50. When the first connector 20 is connected to a proper position, a hollower cylindrical tip part of the relay portion 80 enters the hole portion 70 of the second housing 60 and contacts the second fastening portion 53 of the second terminal 51 as shown in FIG. 6.

Subsequently, the screws are inserted into the mounting holes 45 of the shield shell 43 of the first connector 20 to screw and fix the first connector 20 to the case 90, and the bolt 86 is inserted into the work hole 44 of the first connector 20. Then, the bolt 86 is fastened using a tool (not shown) with the first terminal 21, the relay portion 80 and the second terminal 51 sandwiched between the bolt 86 and the nut 87. In this way, the first and second terminals 21, 51 are electrically connected via the relay portion 80. Thereafter, the insulating cap 36, the sealing cap 38 and the lid 40 are mounted into the work hole 44 to close the work hole 44. In this way, the connector 10 is formed.

According to the configuration of this embodiment, the following functions and effects are achieved.

The connector 10 includes the first terminal 21 formed with the penetrating first fastening hole 25, the first housing 30 for holding the first terminal 21, the second terminal 51 connectable to the external terminal and formed with the penetrating second fastening hole 54, the second housing 60 including the insulating cover portion 68 (cover portion) for covering the second terminal 51 with a part of the second terminal 51 on the side of the first housing 21 exposed and configured to hold the second terminal 51, the conductive relay portion 80 disposed in a part of the second housing 60 where the second terminal 51 is exposed and configured to electrically connect the first and second terminals 21, 51, and the fastening member 85 for fastening the first terminal 21, the second terminal 51 and the relay portion 80 with the relay portion 80 sandwiched between the first and second terminals 21, 51.

According to this embodiment, since the part of the second terminal 51 of the connector 10 on the side of the first terminal 21 is covered by the insulating cover portion 68 of the second housing 60, the contact of the worker with the second terminal 51 can be suppressed by the insulating cover portion 68 when the worker performs an operation on the side of the second housing 60. Thus, an electric shock and the like due to the contact with the second terminal 51 can be suppressed. Further, even in such a configuration, the relay portion 80 is disposed in the part of the second housing 60 where the second terminal 51 is exposed and the first terminal 21, the second terminal 51 and the relay portion 80 are fastened by the fastening member 85, wherefore the first and second terminals 21, 51 can be electrically connected via the relay portion 80. Therefore, it is possible to suppress the contact of the worker or the like with the second terminal 51 during a connector operation in which the first and second terminals 21, 51 are connected by bolting.

Further, the second housing 60 includes the insulating cover portion 68 and the hole portion 70 for exposing a part of the insulating cover portion 68, and the relay portion 80 is inserted into the hole portion 70.

By this arrangement, since the hole portion 70 is covered around by the insulating cover portion 68, the contact of the worker or the like with the second terminal 51 can be even more suppressed.

Further, the relay portion 80 is constituted by a tubular metal piece, and the hole portion 70 forms a tubular space.

By this arrangement, the strength of the relay portion 80 can be enhanced while the configuration thereof is simplified.

Further, the insulating cover portion 68 includes the extending portion 69 extending inwardly of the second fastening hole 54.

By this arrangement, the contact of the worker or the like with the hole wall of the second fastening hole 54 can be suppressed.

Other Embodiments

The technique described in this specification is not limited to the above described and illustrated embodiment. For example, the following embodiments are also included in the technical scope of the technique described in this specification.

(1) Although the housings 30, 60 are formed integrally with the first and second terminals 21, 51 by insert molding in the above embodiment, there is no limitation to this and the first and second terminals 21, 51 may be fixed to separate housings by fixing means such as press-fitting.

(2) Although the second housing 60 holds the nut 87 in the above embodiment, there is no limitation to this and the second housing 60 may hold the bolt 86 and the nut 87 may be inserted into the work hole 44 for bolting.

(3) Although the relay portion 80 is press-fit into the first terminal 21, there is no limitation to this. For example, the relay portion 80 may be fixed to the first terminal 21 by welding or the like. Alternatively, a relay portion may not be fixed to the first terminal 21. The shape of the relay portion may be, for example, a plate-like shape without being limited to the hollow cylindrical shape of the above embodiment.

(4) Although the insulating cover portion 68 is provided with the inner cover portion 68A and the outer cover portion 68B, one of the inner cover portion 68A and the outer cover portion 68B may be provided. Further, although the insulating cover portion 68 is provided with the extending portion 69, the extending portion 69 may not be provided.

(5) Although the first connector 20 is provided with the shield shell 43, a connector may not include the shield shell 43.

LIST OF REFERENCE NUMERALS

10: connector
11: wire
12: conductor portion
13: insulation coating
20: first connector
21: first terminal
22: wire connecting portion
24: first fastening portion
25: first fastening hole
30: first housing
50: second connector
51: second terminal
52: terminal connecting portion
53: second fastening portion
54: second fastening hole
60: second housing
61: receptacle
62: step portion
68: insulating cover portion
69: extending portion
70: hole portion
72: insertion hole
80: relay portion
81: tubular portion

82: protrusion
82A: through hole
85: fastening member
86: bolt
86A: head portion
86B: shaft portion
87: nut
90: case
91: connector insertion hole

What is claimed is:

1. A connector, comprising:

a first terminal formed with a penetrating first fastening hole;

a first housing for holding the first terminal;

a second terminal connectable to an external terminal, the second terminal being formed with a penetrating second fastening hole;

a second housing including an insulating cover portion for covering the second terminal with a part of the second terminal on the side of the first terminal exposed, the second housing holding the second terminal;

a conductive relay portion disposed in a part of the second housing where the second terminal is exposed, the conductive relay portion electrically connecting the first terminal and the second terminal; and a fastening member for fastening the first terminal, the second terminal and the conductive relay portion with the conductive relay portion sandwiched between the first terminal and the second terminal.

2. The connector of claim 1, wherein:

the second housing includes the cover portion and a hole portion for exposing a part of the cover portion, and the conductive relay portion is inserted into the hole portion.

3. The connector of claim 2, wherein:

the conductive relay portion is constituted by a tubular metal piece, and the hole portion forms a tubular space.

4. The connector of claim 1, wherein the cover portion includes an extending portion extending inwardly of the second fastening hole.

* * * * *